US007650951B1

(12) United States Patent
Hall et al.

(10) Patent No.: US 7,650,951 B1
(45) Date of Patent: Jan. 26, 2010

(54) RESETTABLE ACTUATOR FOR DOWNHOLE TOOL

(76) Inventors: David R. Hall, 2185 S. Larsen Pkwy., Provo, UT (US) 84606; Scott Dahlgren, 2185 S. Larsen Pkwy., Provo, UT (US) 84606; Nathan Nelson, 2185 S. Larsen Pkwy., Provo, UT (US) 84606; David Lundgreen, 2185 S. Larsen Pkwy., Provo, UT (US) 84606

( * ) Notice: Subject to any disclaimer, the term of this patent is extended or adjusted under 35 U.S.C. 154(b) by 0 days.

(21) Appl. No.: 12/424,901

(22) Filed: Apr. 16, 2009

Related U.S. Application Data

(63) Continuation of application No. 12/424,853, filed on Apr. 16, 2009.

(51) Int. Cl.
*E21B 7/04* (2006.01)
*E21B 19/24* (2006.01)

(52) U.S. Cl. ..... 175/57; 175/73; 175/267; 175/325.1

(58) Field of Classification Search ..... 175/57, 175/73, 267, 324, 325.1
See application file for complete search history.

(56) References Cited

U.S. PATENT DOCUMENTS 1,921,135 A 8/1933 Santiago
2,170,452 A 8/1939 Grant
2,427,052 A 9/1947 Grant
3,126,085 A 3/1964 Chadderdon
3,703,104 A 11/1972 Tamplen
3,823,773 A 7/1974 Nutter
3,986,554 A 10/1976 Nutter
4,081,042 A 3/1978 Johnson
4,491,187 A 1/1985 Russell
4,596,293 A * 6/1986 Wallussek et al. ..... 340/853.6
4,655,289 A 4/1987 Schoeffler
4,869,100 A * 9/1989 Birdwell ..... 367/85
4,895,214 A 1/1990 Schoeffler
5,230,390 A 7/1993 Zastresek
5,316,094 A 5/1994 Pringle
5,499,687 A 3/1996 Lee
5,553,678 A 9/1996 Barr
5,609,178 A 3/1997 Hennig
5,673,763 A 10/1997 Thorp
5,685,379 A 11/1997 Barr
5,695,015 A 12/1997 Barr
5,706,905 A 1/1998 Barr
5,730,222 A 3/1998 Rike
5,803,185 A 9/1998 Barr
6,089,332 A 7/2000 Barr (Continued)

*Primary Examiner*—Hoang Dang
(74) *Attorney, Agent, or Firm*—Phillip W. Townsend, III; Tyson J. Wilde

(57) ABSTRACT

In one embodiment of the invention, a downhole tool string component comprising a through bore running there through formed to accept drilling fluid. At least one mechanical actuation device is also disposed within the through bore. A guide channel is disposed within the through bore and comprises a geometry shaped to conduct the at least one mechanical actuation device. A switch is disposed within the guide channel in an original position and actuatable by the at least one mechanical actuation device to a subsequent position. A resettable mechanism is in contact with the switch wherein the resettable mechanism returns the switch to its original position. A receptacle may also be disposed within the through bore comprising a geometry shaped to accept the at least one mechanical actuation device.

20 Claims, 22 Drawing Sheets

U.S. PATENT DOCUMENTS

| | | | | |
|---|---|---|---|---|
| 6,142,250 | A | 11/2000 | Griffin | |
| 6,382,330 | B2 * | 5/2002 | Bischel et al. | 175/24 |
| 6,717,283 | B2 | 4/2004 | Skinner | |
| 6,732,817 | B2 | 5/2004 | Dewey | |
| 6,854,953 | B2 | 2/2005 | Van Drentham-Susman | |
| 7,036,611 | B2 | 5/2006 | Radford | |
| 7,048,078 | B2 | 5/2006 | Dewey | |
| 7,261,184 | B2 * | 8/2007 | Bass et al. | 187/242 |
| 7,308,937 | B2 | 12/2007 | Radford | |
| 2004/0256153 | A1 * | 12/2004 | Helms et al. | 175/45 |
| 2005/0145417 | A1 | 7/2005 | Radford | |
| 2008/0105464 | A1 | 5/2008 | Radford | |
| 2008/0217024 | A1 * | 9/2008 | Moore | 166/382 |
| 2009/0044951 | A1 * | 2/2009 | Milkovisch et al. | 166/369 |
| 2009/0166086 | A1 * | 7/2009 | Sugiura | 175/25 |

* cited by examiner

RESETTABLE ACTUATOR FOR DOWNHOLE TOOL

CROSS REFERENCE TO RELATED APPLICATIONS

This application is a continuation of U.S. patent application Ser. No. 12/424,853 filed on Apr. 16, 2009.

BACKGROUND OF THE INVENTION

This invention relates to actuating downhole tools, specifically tools for oil, gas, geothermal, and horizontal drilling. Downhole tool actuation is sometimes accomplished by dropping a ball down a bore of a drill string which may lead to the breaking of a shear pin, which, upon breaking, frees a valve to open, thus actuating a tool such as a reamer or stabilizer. Once the pin is broken however, the drill string must generally be removed from the hole and the pin replaced before the tool can be actuated again.

U.S. Pat. No. 7,308,937 to Radford, et al. which is herein incorporated by reference for all that it contains, discloses that a flow restriction element may be disposed within a drill string to actuate the expansion of an expandable reamer. For instance, a ball may be disposed within the drilling fluid, traveling therein, ultimately seating within an actuation sleeve disposed at a first position. Pressure from the drilling fluid may subsequently build to force the ball and actuation sleeve, optionally held in place by way of a shear pin or other friable member, into a second position, thereby actuating the expansion of the expandable reamer. Such a configuration may require that once the movable blades are expanded by the ball, in order to contract the movable blades, the flow is diverted around the seated ball to allow a maximum fluid flow rate through the tool. Thus, the expandable reamer may be configured as a "one shot" tool, which may be reset after actuation.

BRIEF SUMMARY OF THE INVENTION

In an embodiment of the invention, a downhole tool string component comprises a through bore running there through formed to accept drilling fluid. At least one mechanical actuation device is also disposed within the through bore. A guide channel may be disposed within the through bore comprising a geometry shaped to conduct the mechanical actuation device. A switch within the guide channel may be in an original position but actuatable to a subsequent position. A resettable mechanism in contact with the switch may return the switch to its original position after it has been actuated. A receptacle disposed within the through bore may accept the mechanical actuation device after it has passed through the guide channel. A shaft may be in mechanical communication with the switch wherein the shaft attains a new position when the switch is actuated and a ratcheting device maintains the shaft in the new position when the switch is reset to its original position. The new position may be an axial rotation from the original position.

In various embodiments, a plurality of mechanical actuation devices of substantially the same shape or of varying diameter may be disposed within the through bore. A funnel disposed within the through bore may comprise an exit attached to the guide channel and an opening larger than the exit. The mechanical actuation device may be a ball. The guide channel may comprise a cylindrical duct comprising a geometry shaped to conduct the ball. The guide channel may comprise a plurality of exits of varying diameter. The guide channel may sit on a plane substantially perpendicular to or on a plane substantially parallel to an axis of the downhole tool string component. The at least one mechanical actuation device may comprise a material substantially dissolvable in drilling fluid or a material that can be ground into pieces small enough to exit without hindrance. The switch may comprise an arm, bar, lever, turnstile, handle or knob. The resettable mechanism may comprise a coiled spring, elastic member, compressible element, or a combination thereof. The receptacle may comprise a cylindrical trough comprising a geometry shaped accept a ball. The receptacle may comprise a bin comprising an opening at a first end comprising a geometry shaped to accept a ball and a second end comprising a geometry shaped to restrict the ball. The second end may comprise a grate formed to accept drilling fluid.

Actuating the downhole tool may comprise funneling the at least one mechanical actuation device into the guide channel disposed within the through bore, actuating the switch disposed within the guide channel to its subsequent position with the mechanical actuation device, returning the switch to its original position with the resettable mechanism, and accepting the mechanical actuation device in a receptacle. The shaft may then be moved to a new position when the switch is actuated and then held in the new position with a ratcheting device. A second mechanical actuation device may then be funneled into the guide channel and there actuate the switch from its original position to its subsequent position. The switch may then be returned to its original position with the resettable mechanism and the second mechanical actuation device would then be accepted in the receptacle. The at least one mechanical actuation device and the second mechanical actuation device may then be stacked in the receptacle.

In an alternative embodiment, a downhole tool string component may comprise a through bore running there through formed to accept drilling fluid, a sealed chamber disposed within the through bore, a pump disposed within the sealed chamber, a valve mechanism that selectively opens a hydraulic line in fluid communication with the pump, and a gear motor in fluid communication with the hydraulic line.

Another embodiment of a downhole tool string component may comprise a through bore running there through formed to accept drilling fluid, a sealed chamber disposed within the through bore, a pump disposed within the sealed chamber, a piston assembly comprising a piston with a head within a cylinder within the sealed chamber and an end extending beyond the sealed chamber, the cylinder comprising at least one entry port fluidly connected to the pump, and a valve mechanism that selectively opens the at least one entry port.

The valve mechanism may be actuated by a solenoid that is in electrical communication with a downhole network. The valve mechanism may alternately be actuated by a cam that is in mechanical communication with a ratcheting device. The valve mechanism may also be actuated by a motor in electrical communication with a telemetry network.

The end of the piston may be attached to an axially translatable sleeve within the through bore. The axially translatable sleeve may comprise at least one port, wherein the port is spaced on the sleeve to align with a channel formed within a wall of the through bore. A translatable plunger may be fluidly connected to the through bore when the port is aligned with the channel. The translatable plunger may be in mechanical communication with a reamer or stabilizer on an exterior of the component.

In certain embodiments, the pump may be a gear pump and/or the valve mechanism may be a spool valve, ball valve, or other type of valve. The pump may be powered by a turbine disposed within the through bore and/or by a battery. A release valve may be in fluid communication with the pump. The cylinder may comprise a plurality of exhaust ports each fluidly connected to the pump and a multi-way valve may selectively open the plurality of exhaust ports. The plurality of exhaust ports may be spaced along the length of the cylinder.

An exhaust reservoir may be fluidly connected to the cylinder. The exhaust reservoir may comprise a volume adjustment piston slidably disposed within the exhaust reservoir and a spring such that an axial load may be applied to the volume adjustment piston.

The piston may be incrementally moved by pumping hydraulic fluid to a first end of the cylinder from the pump, displacing the piston a first distance from the first end of the cylinder toward a second end of the cylinder, displacing the piston a second distance from the first end of the cylinder toward the second end of the cylinder, and exhausting hydraulic fluid from the second end of the cylinder. The hydraulic fluid may be exhausted to the exhaust reservoir. In some embodiments, an axially translatable sleeve may be pushed within the through bore with the piston. The port on the sleeve may be aligned with a channel formed within the wall of the through bore. Drilling fluid may be supplied through the port from the through bore. The plunger may be pressed with the drilling fluid, and a reamer and/or stabilizer may advance from the exterior of a downhole tool string component.

DETAILED DESCRIPTION OF THE INVENTION AND THE PREFERRED EMBODIMENT

Figure 1:
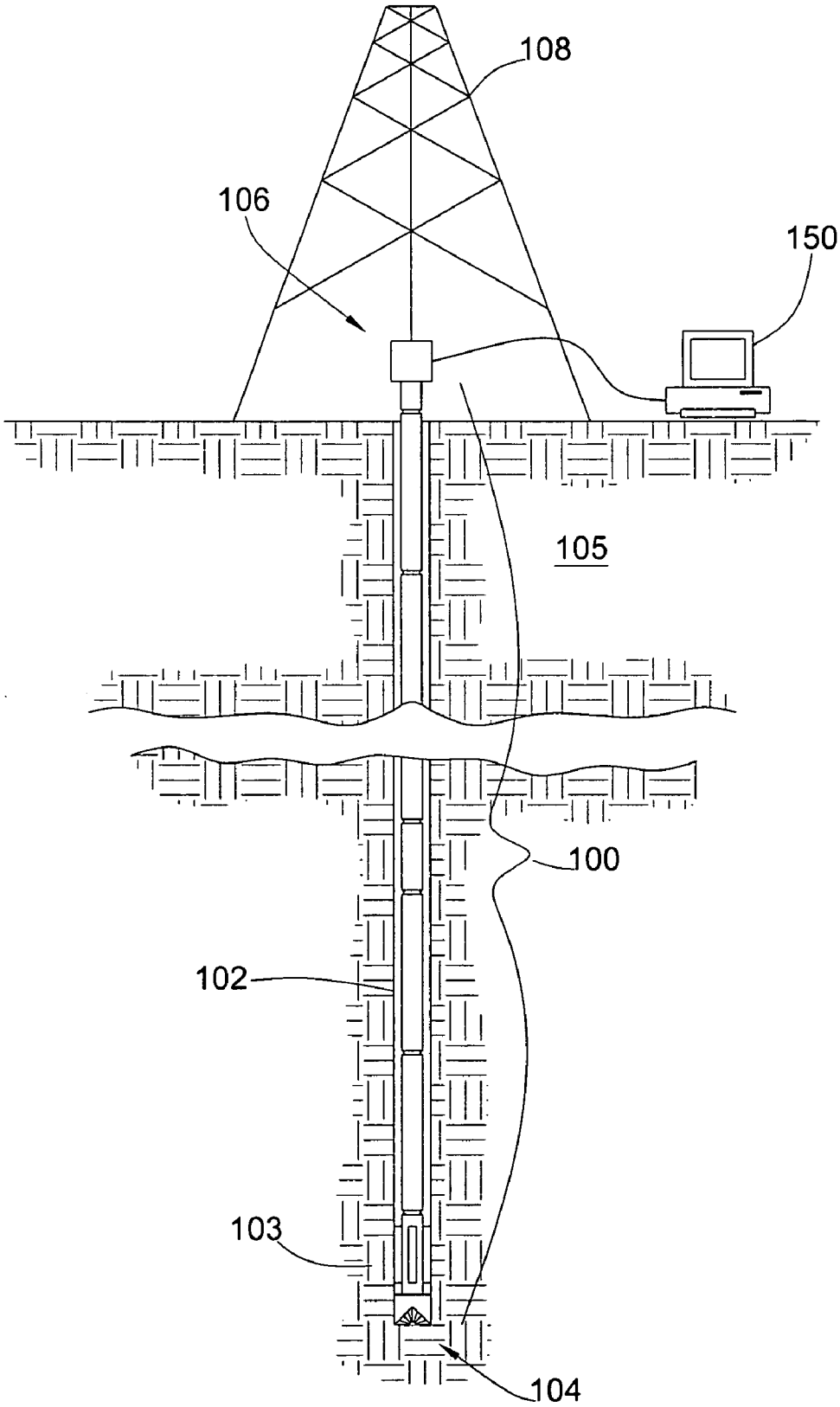
FIG. 1 is a perspective diagram of an embodiment of a drill string suspended in a borehole.

Moving now to the figures, FIG. 1 is a perspective diagram of an embodiment of a drill string 100 suspended by a derrick 108 in a bore hole 102. A drilling assembly 103 is located at the bottom of the bore hole 102 and comprises a drill bit 104. As the drill bit 104 rotates downhole the drill string 100 may advance into subterranean formations 105. The drilling assembly 103 and/or downhole components may comprise data acquisition devices adapted to gather data. The data may be sent to the surface via a transmission system to a data swivel 106. The data swivel 106 may send the data to surface equipment 150 which may send data and/or power to downhole tools, the drill bit 104 and/or the drilling assembly 103 via the data swivel 106.

Figure 2A:
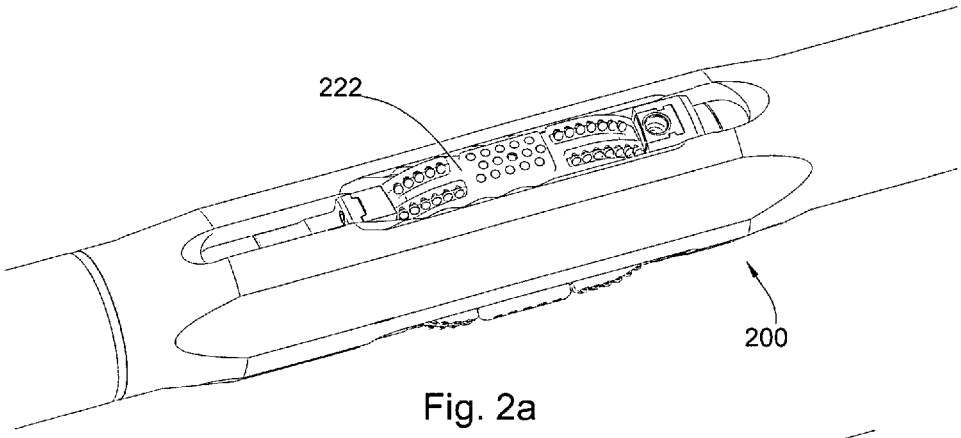
FIG. 2*a* is a perspective diagram of an embodiment of a downhole tool string component comprising a reamer.

FIG. 2*a* is a perspective diagram of an embodiment of a downhole drill string component 200 comprising a reamer 222. The reamer 222 may be adapted to extend into and retract away from a wall of a bore hole. While against the wall, the reamer 222 may be adapted to enlarge the diameter of the bore hole.

Figure 2B:
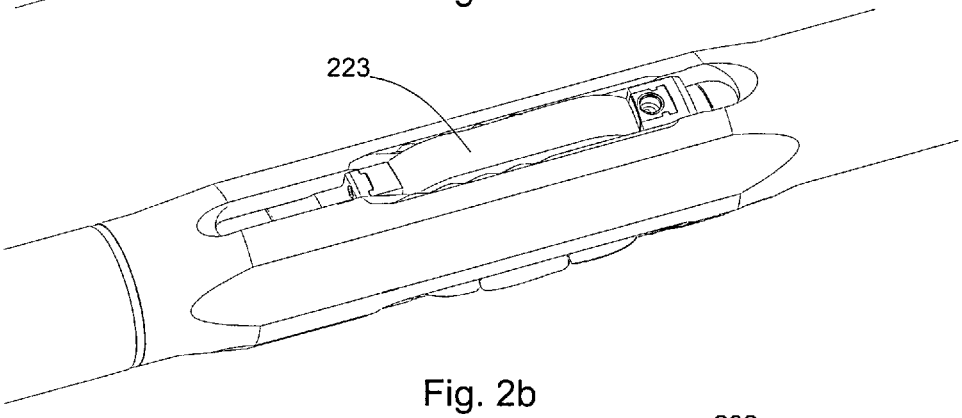
FIG. 2*b* is a perspective diagram of an embodiment of a downhole tool string component comprising a stabilizer.

FIG. 2*b* is a perspective diagram of an embodiment of a downhole drill string component 200 comprising a stabilizer 223. The stabilizer 223 may be adapted to extend into and retract away from a wall of a bore hole. While against the wall, the stabilizer 223 may be adapted to stabilize the component 200. The component 200 may additionally or alternately comprise a packer that is actuated similarly to the reamer 222 and/or stabilizer 223.

Figure 2C:
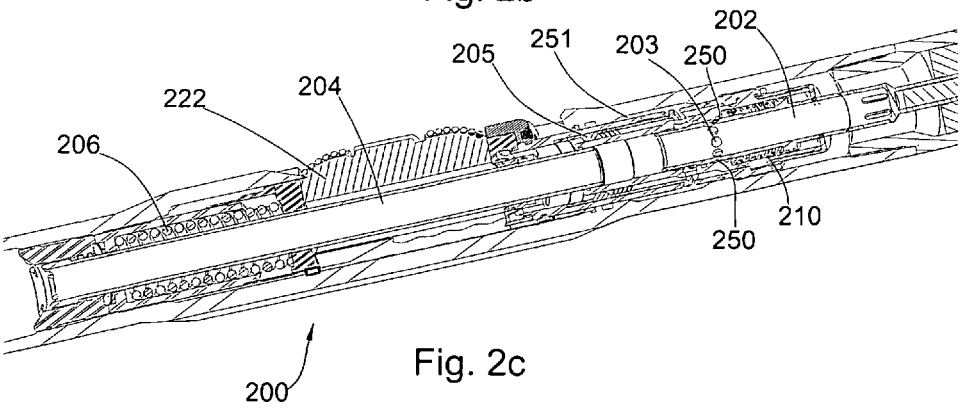
FIG. 2*c* is a cross-sectional diagram of an embodiment of a downhole tool string component comprising a reamer.

FIG. 2*c* is a cross-sectional diagram of an embodiment of a reamer 222. A sleeve 202 located within a through bore 204 of a tool sting component 200 may comprise ports 203. The ports 203 may be adapted to divert drilling fluid from the through bore 204 when aligned with openings 250 formed in the wall of through bore 204. The diverted drilling fluid may engage a translatable plunger 205 located in a chamber 251 otherwise isolated from the through bore 204. Afterwards, the drilling fluid may be re-diverted back into the through bore 204 of the tool string component 200. A ramp formed in the reamer 222 may cause the reamer 222 to extend radially as an axial force from the translatable plunger 205 is applied. The translatable plunger 205 and reamer 222 may stay extended by a dynamic force from flowing drilling fluid. The reamer 222 may be in mechanical communication with a spring 206 or other urging mechanism adapted to push the reamer 222 back into a retracted position in the absence of the dynamic drilling fluid force. A reamer that may be compatible with the present invention, with some modifications, is disclosed in U.S. Pat. No. 6,732,817 to Smith International, which is herein incorporated by reference for all that it contains.

In various embodiments, a pause in drilling fluid flow may cause the reamer 222 to retract. The sleeve 202 may be moved by an axial spring 210 such that the ports 203 and openings 250 misalign thus cutting off the dynamic force and retracting the reamer 222. The sleeve 202 may be moved to realign and misalign on command to control the position of the reamer 222. In some embodiments, the sleeve 202 is adapted to partially align with the openings 250, allowing a fluid flow less than its maximum potential to engage the translatable plunger 205, and extend the reamer 222 less than its maximum diameter.

Figure 3:
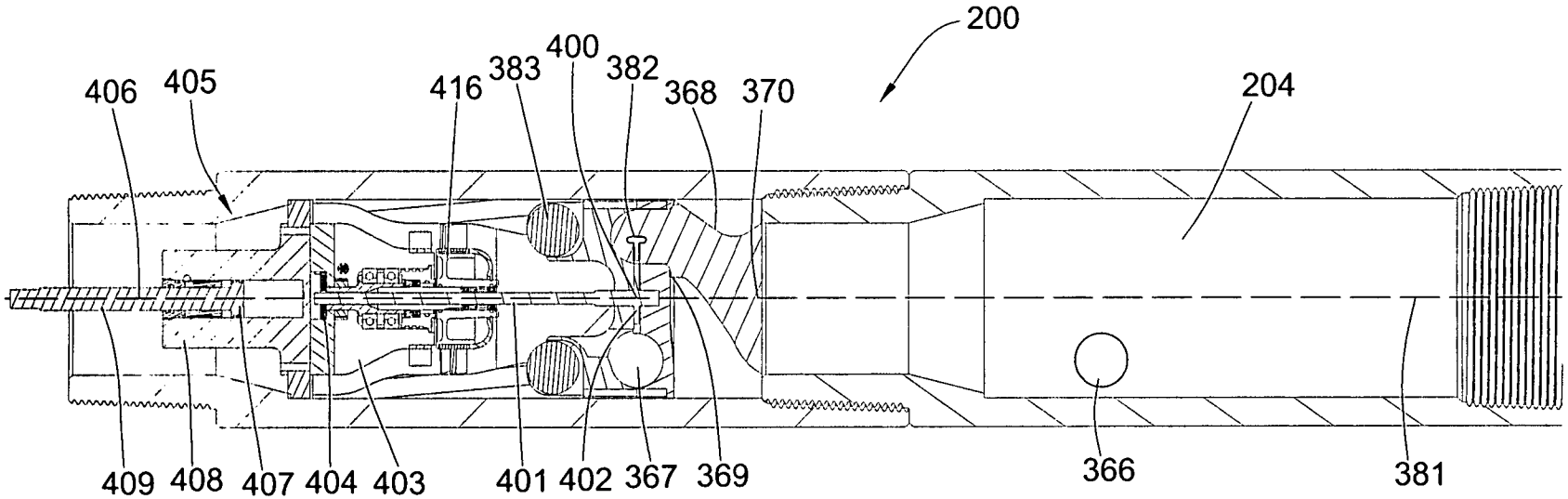
FIG. 3 is a cross-sectional diagram of an embodiment of a downhole tool string component.

FIG. 3 is a cross-sectional diagram of an embodiment of a downhole tool string component 200. The tool string component 200 may comprise a through bore 204 running through the tool string component 200 and formed to accept drilling fluid. The through bore 204 may extend the entire length of the component 200, or in some embodiments may extend the length of only a portion of the component 200.

The downhole tool string component 200 may also comprise at least one mechanical actuation device 366 disposed within the through bore 204. In some embodiments, the component 200 may comprise a plurality of mechanical actuation devices 366 of substantially the same shape disposed within the through bore 204. The at least one mechanical actuation device 366 may travel within the through bore 204 and be pushed along the component 200 by drilling fluid. The mechanical actuation device 366 may be a ball or other spherical object. The mechanical actuation device 366 may also be dissolvable in drilling fluid or crushable into pieces small enough to exit without hindrance.

The tool string component 200 may also comprise a guide channel 367 disposed within the through bore 204 and comprising a geometry shaped to conduct the at least one mechanical actuation device 366. The at least one mechanical actuation device 366 may be directed to the guide channel 367 by a funnel 368 disposed within the through bore 204 and comprising an exit 369 attached to the guide channel 367 and an opening 370 larger than the exit 369. Drilling fluid may aid in funneling the mechanical actuation device 366. The guide channel 367 may be a cylindrical duct substantially the same shape as the mechanical actuation device 366 and comprising a diameter larger than the diameter of the mechanical actuation device 366 thus allowing the drilling fluid to force the mechanical actuation device 366 through the guide channel 367. The guide channel 367 may also sit on a plane substantially perpendicular to an axis 381 of the downhole tool string component 200. In other embodiments, the guide channel 367 may sit in a plane substantially parallel to the axis 381 of the downhole tool string component 200. The downhole drill string component 200 may comprise a switch 382 disposed within the guide channel 367 in an original position and actuatable by the at least one mechanical actuation device 366 to a subsequent position. The switch 382 may comprise an arm, bar, switch, turnstile, handle or knob. The switch 382 may extend into the guide channel 367 such that as the mechanical actuation device 366 is forced by the drilling fluid through the channel 367, the switch 382 is actuated by the mechanical actuation device 366. After having actuated the switch 382, the mechanical actuation device 366 may be received by a receptacle 383 disposed within the through bore 204. The receptacle 383 may comprise a cylindrical trough.

The component 200 may comprise a resettable mechanism 400 in mechanical communication with the switch 382 and adapted to return the switch 382 to its original position after having been rotated to a subsequent position. The resettable mechanism 400 may comprise a coiled spring, elastic member, compressible element, or a combination thereof. The resettable mechanism 400 may exert a force on the switch 382 to bring it back to the original position which is greater than a force the drilling fluid may exert on the switch 382 as it flows along the drill string.

The component 200 may comprise a shaft 401 in mechanical communication with the switch 382, wherein the shaft 401 attains a new position when the switch 382 is actuated. A ratcheting device 402 may also be comprised within the component 200 wherein as the shaft 401 attains a new position, the ratcheting device 402 maintains the shaft 401 in the new position. The new position of the shaft 401 may be an axial rotation from the original position. The new position may also be an axial translation from the original position. The ratcheting device 402 may be in mechanical communication with a cam 660 (see FIG. 6) adapted to index each time the shaft 401 is indexed.

A second ball may additionally be released into the through bore 204 and accepted into the guide channel 367 by means of the funnel 368 and there actuate the switch 382. The second ball may then be received into the receptacle 383 and the switch 382 returned back to its original position by means of the resettable mechanism 400.

The component 200 may comprise a sealed chamber 403 disposed within the through bore 204. A pump 404 may be disposed within the sealed chamber 403. The pump 404 may be a gear pump. The component 200 may also comprise a piston assembly 405 comprising a piston 406 with a head 407 within a cylinder 408 within the sealed chamber 403 and an end 409 extending beyond the sealed chamber 403. The piston end 409 may be attached to an axially translatable sleeve 202 within the through bore 204 (see FIG. 2*c*). The axially translatable sleeve 202 may comprise at least one port 203, wherein the at least one port 203 is spaced on the sleeve 202 to align with a channel 250 formed within a wall of the through bore 204 (see FIG. 2*c*).

Figure 4:
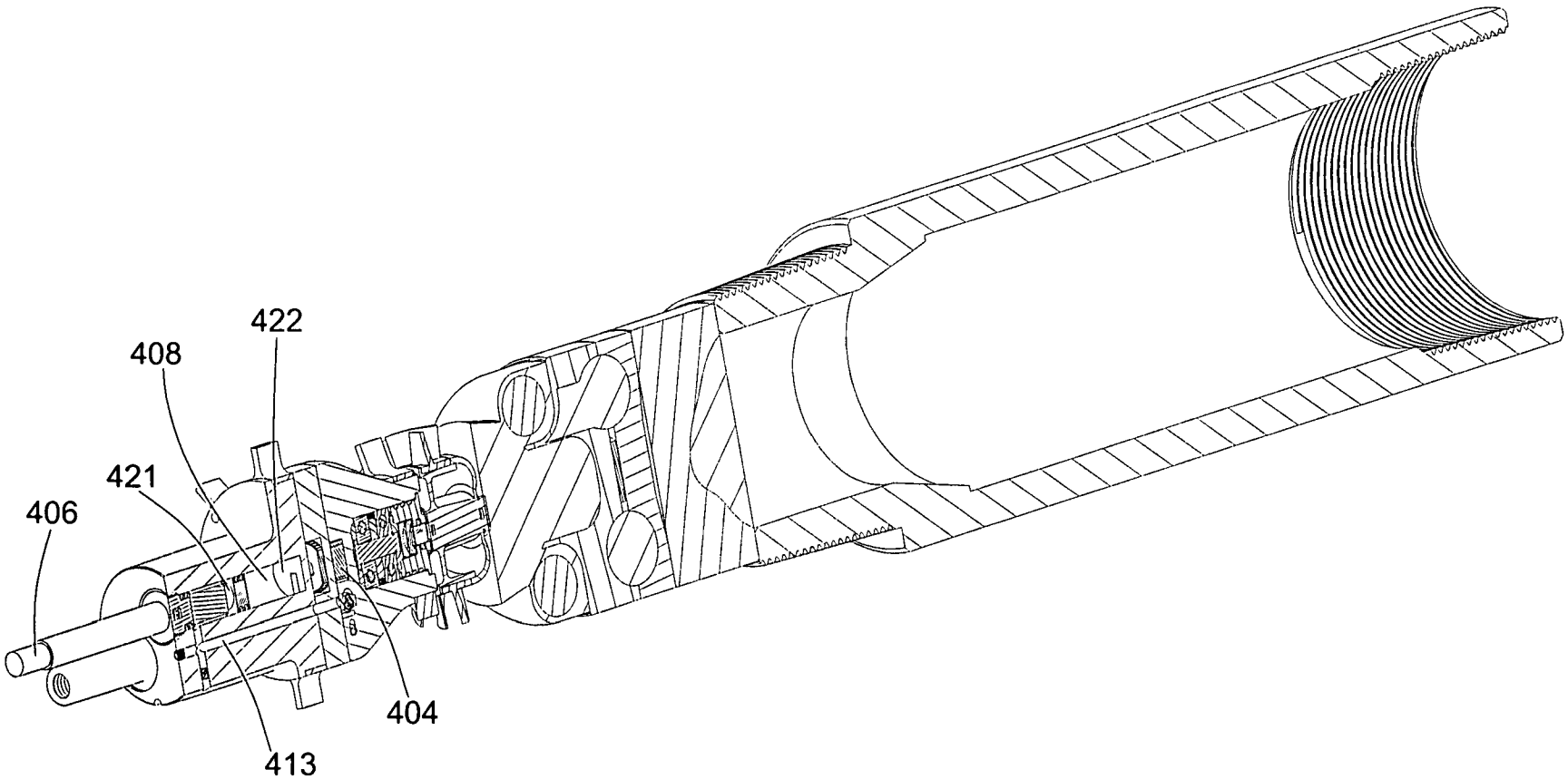
FIG. 4 is a perspective cross-sectional diagram of an embodiment of a downhole tool string component.
Figure 5:
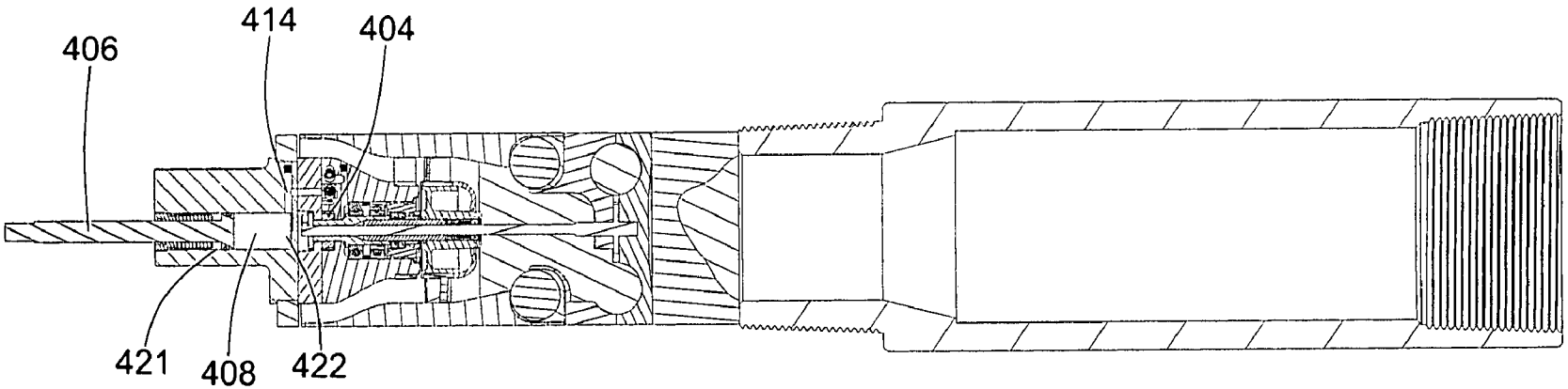
FIG. 5 is a cross-sectional diagram of an embodiment of a downhole tool string component.

Referring to FIGS. 4 and 5, the cylinder 408 may comprise at least one hydraulic line 413, 414 fluidly connected to the pump 404. In some embodiments, the cylinder 408 may comprise a plurality of hydraulic lines 413, 414. In this particular embodiment, the cylinder 408 comprises two hydraulic lines 413 and 414 each fluidly connected to the pump 404 with a first hydraulic line 413 displayed in FIG. 4 and a second hydraulic line 414 displayed in FIG. 5.

The piston 406 may be moved within the cylinder 408 by first pumping hydraulic fluid to a first end 421 of the cylinder 408 from the pump 404. The piston 406 may then be moved by the hydraulic pressure exerted on the piston 406. After reaching the second end 422 of the cylinder 408, the piston 406 may then be returned to the first end 421 of the cylinder 408 by pumping hydraulic fluid to the second end 422 of the cylinder 408 and forcing the piston 406 toward the first end 421. As one end of the cylinder 408 is filled with hydraulic fluid, the opposite end may be exhausted into the exhaust reservoir 418. (See FIG. 7)

Figure 6:
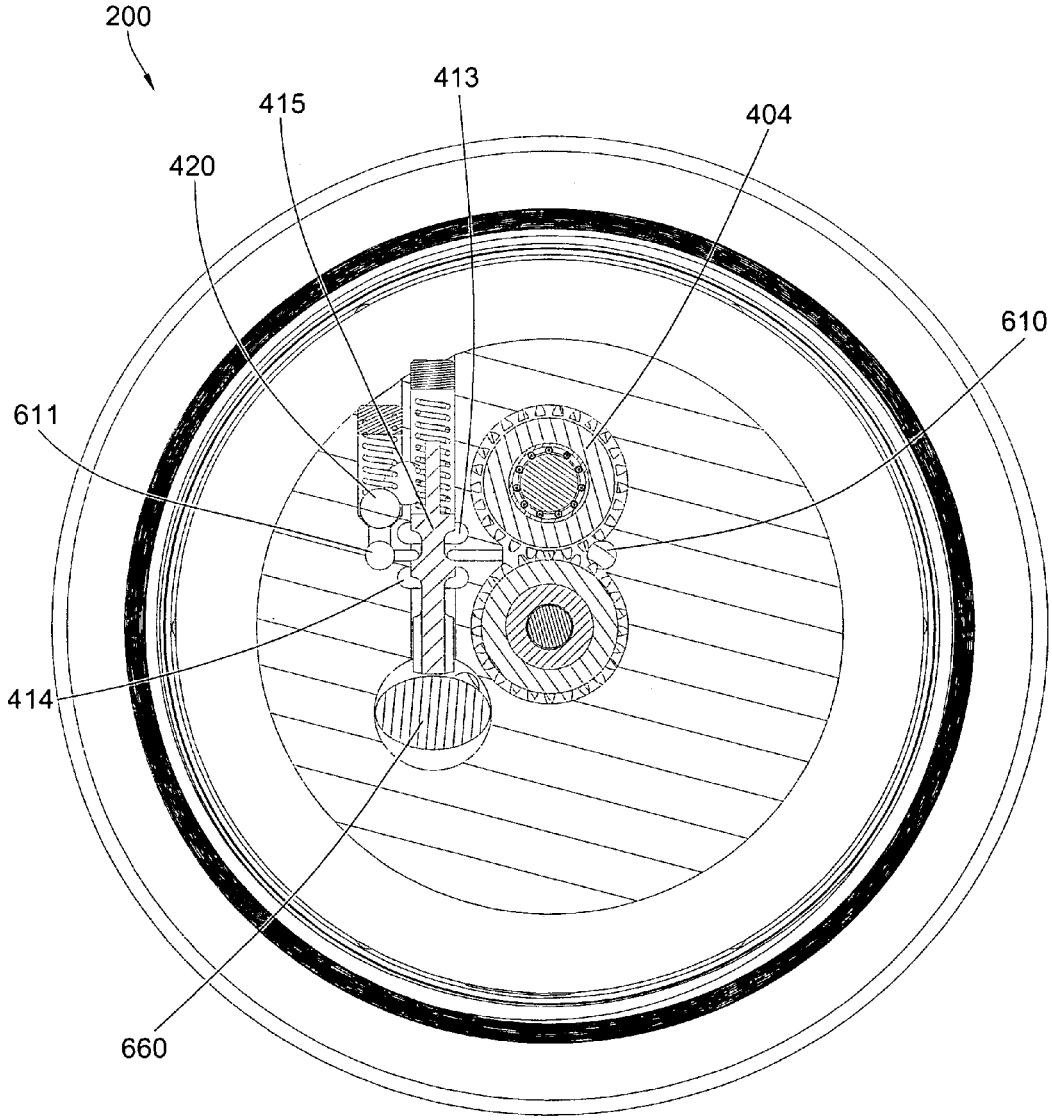
FIG. 6 is an axial cross-sectional diagram of an embodiment of a downhole tool string component.

FIG. 6 is a cross-sectional diagram of an embodiment of a downhole tool string component 200. A valve mechanism 415 may be comprised within the component 200 and adapted to selectively open a first hydraulic line 413. The valve mechanism 415 may comprise a spool valve (as shown in this embodiment), a ball valve or other type of valve. The valve mechanism 415 may also comprise a multi-way valve that selectively opens a plurality of hydraulic lines 413, 414. The plurality of hydraulic lines 413, 414 may be spaced along the length of the cylinder 408 (see FIGS. 4 and 5).

The pump 404 may be housed within component 200 and may be adapted to move hydraulic fluid from a suction port 610 to an exhaust port 611. The cam 660 may index the valve mechanism 415 such that a first hydraulic line 413 is opened. The hydraulic fluid being pumped from the pump 404 may pass through the valve mechanism 415 and into the first hydraulic line 413. The first hydraulic line 413 may pump the hydraulic fluid to an end of the cylinder (not shown). Indexing the cam 660 again may shift the valve mechanism 415 to a new position allowing the hydraulic fluid pumped by the pump 404 to enter a second hydraulic line 414 adapted to transport the hydraulic fluid to another end of the cylinder. A release valve 420 may be comprised within the component 200 allowing for an overflow of hydraulic fluid in the case of a pressure build-up.

Figure 7:
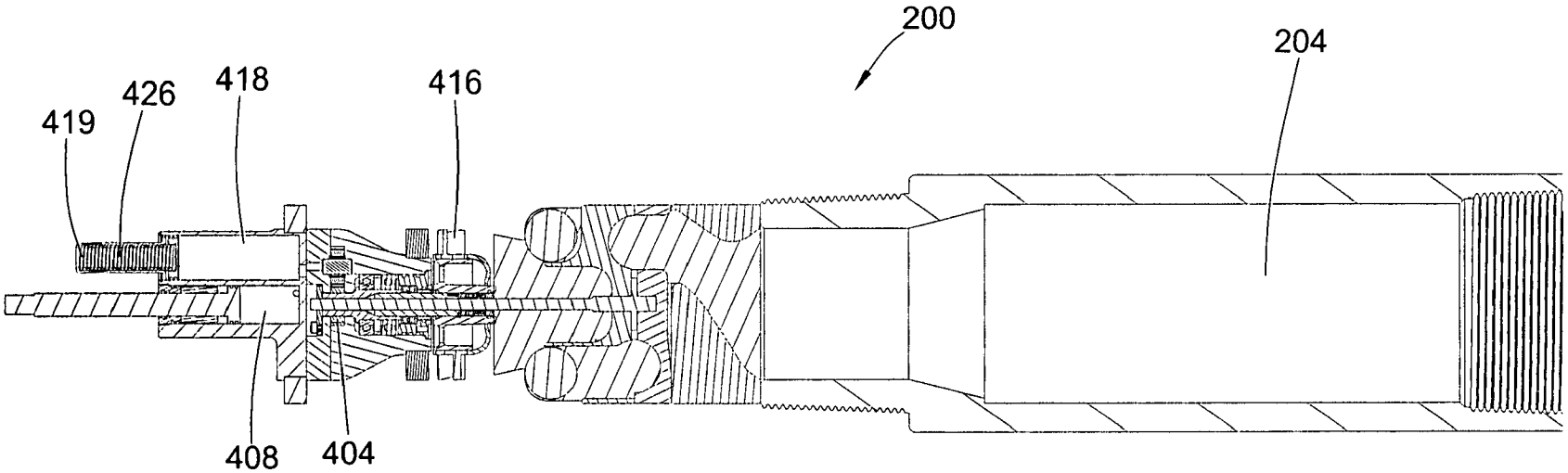
FIG. 7 is a cross-sectional diagram of an embodiment of a downhole tool string component comprising an exhaust reservoir.
Figure 8:
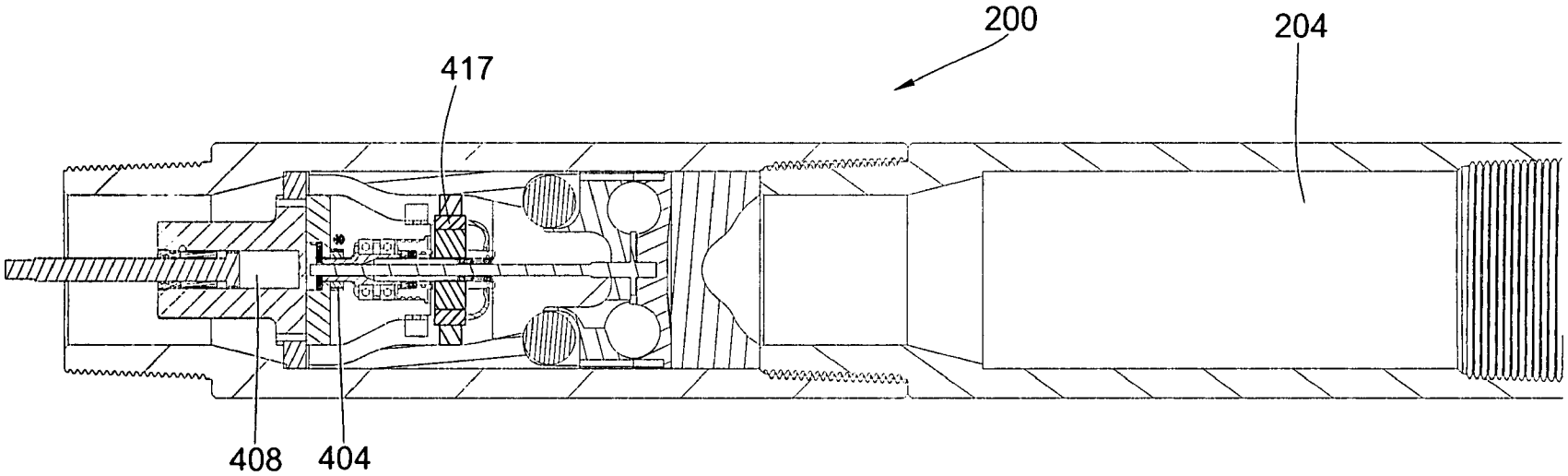
FIG. 8 is a cross-sectional diagram of an embodiment of a downhole tool string component comprising a battery.

Referring to FIGS. 7 and 8, a turbine 416 may be disposed within the through bore 204 of the downhole tool string component 200 and adapted to power the pump 404. The pump 404 may also be powered by a battery 417. The component 200 may also comprise an exhaust reservoir 418 fluidly connected to the cylinder 408. A volume adjustment piston 426 may be disposed within the exhaust reservoir 418 and adapted to slidably reposition within the exhaust reservoir 418 to accommodate an increase or decrease in hydraulic fluid. A spring 419 may be disposed within the exhaust reservoir 418 and adapted to apply an axial load to the volume adjustment piston 426.

Referring to FIGS. 9 through 13, an alternative embodiment of the downhole drill string component 200 is shown. In this embodiment, the turbine 416 may power the pump 404. The pump 404 may pump hydraulic fluid from a sealed chamber 403 to a hydraulic input 455 to a cylinder 408. As the piston 406 within the cylinder 408 is advanced, the piston 406 may pass exhaust ports 405 disposed along the length of the cylinder 408 and selectively activated by the valve mechanism 415. When the piston 406 passes an open exhaust port 405, the piston 406 may extend past the open exhaust port 405, allowing the hydraulic fluid to exhaust through the port 405, leaving the piston 406 proximate the open exhaust port 405. As the valve mechanism 415 is indexed, it may open a new exhaust port 405 while closing the open exhaust port 405. With the pump 404 pumping hydraulic fluid into the hydraulic input 455, the piston 406 may then be extended to the newly opened exhaust port 405.

While the pump 404 may move the piston 406 in a direction away from the hydraulic input 455, an axial spring 210 (see FIG. 2*c*) disposed opposite the hydraulic input 455 may drive the piston 406 back towards the hydraulic input 455. This process of indexing the valve mechanism 415 and opening a new exhaust port 405 to extend the piston 406 may be repeated to extend the piston 406 to another open exhaust port 405 as shown in FIGS. 10 through 13. The piston 406 may be moved sequentially from one exhaust port 405 to the next or may be moved selectively to any exhaust port 405.

Figure 9:
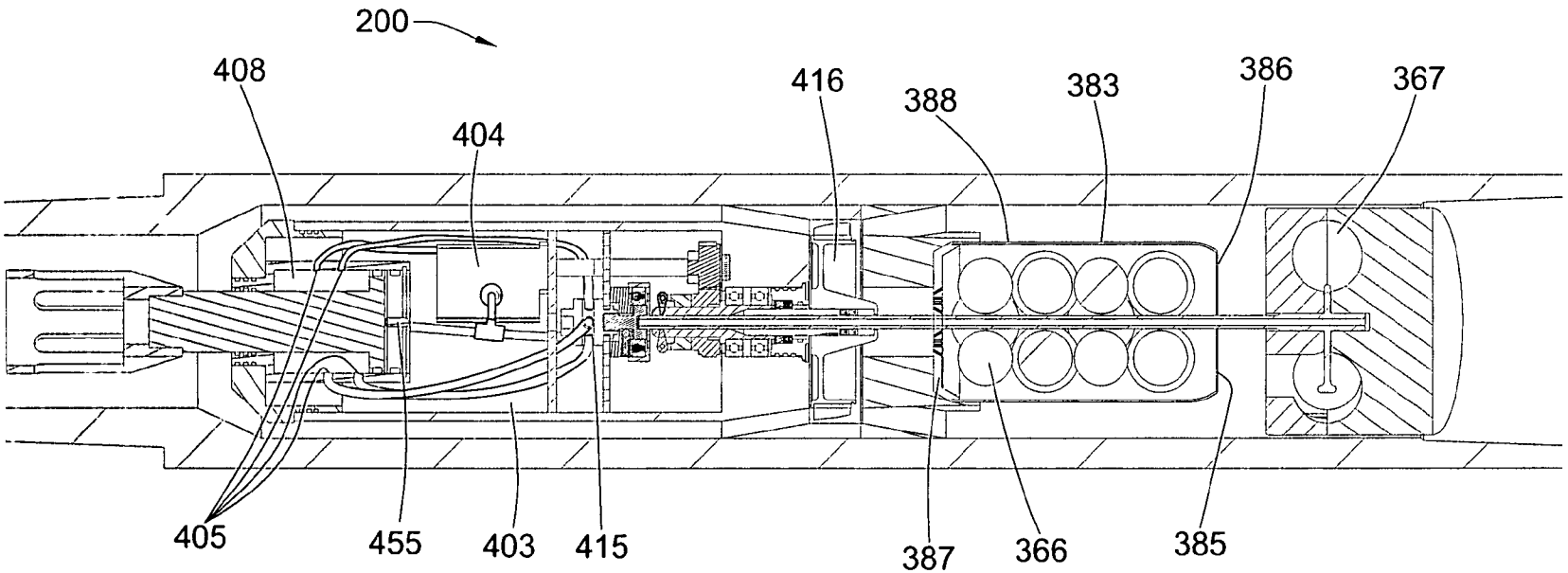
FIGS. 9 through 13 are cross-sectional diagrams of an alternate embodiment of a downhole tool string component.
Figure 10:
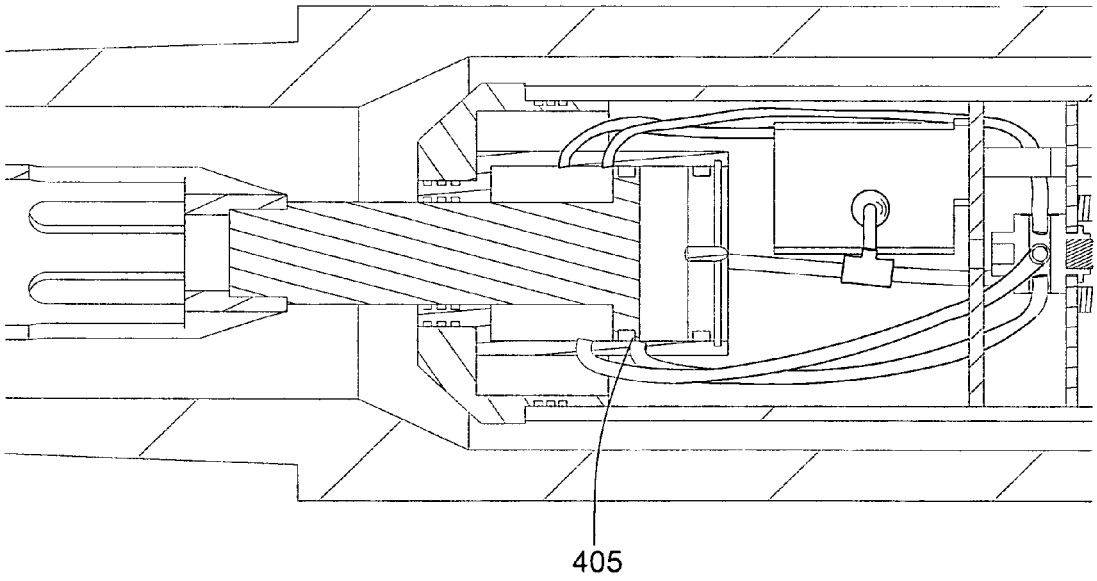
Figure 11:
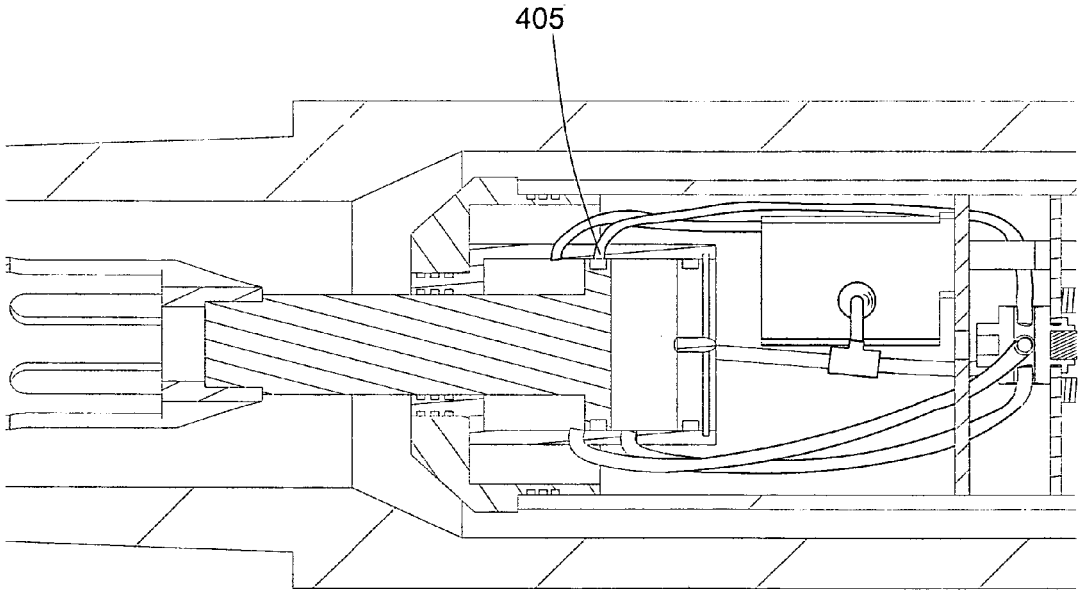
Figure 12:
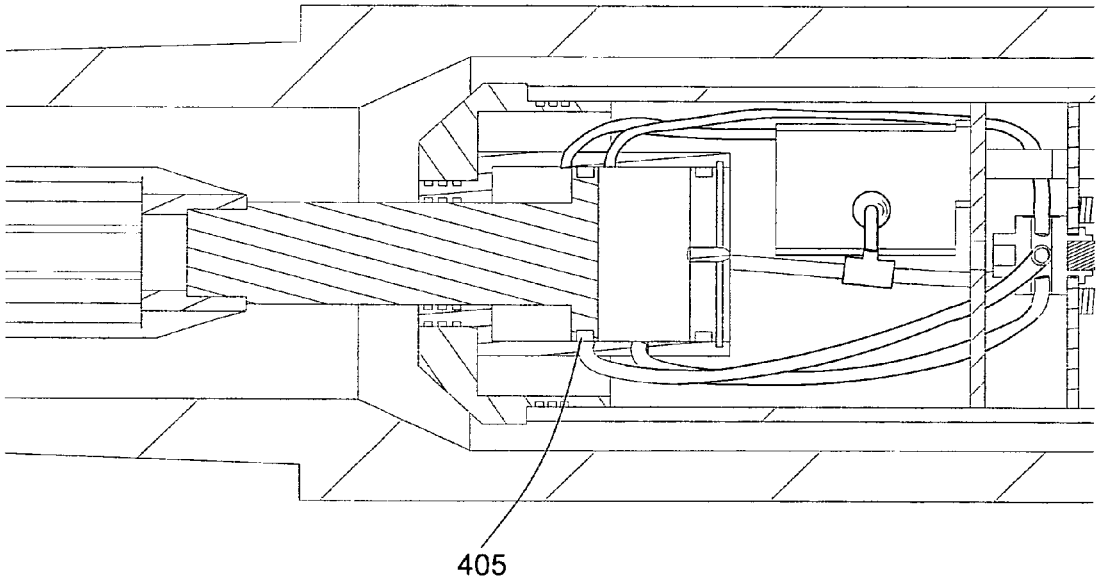
Figure 13:
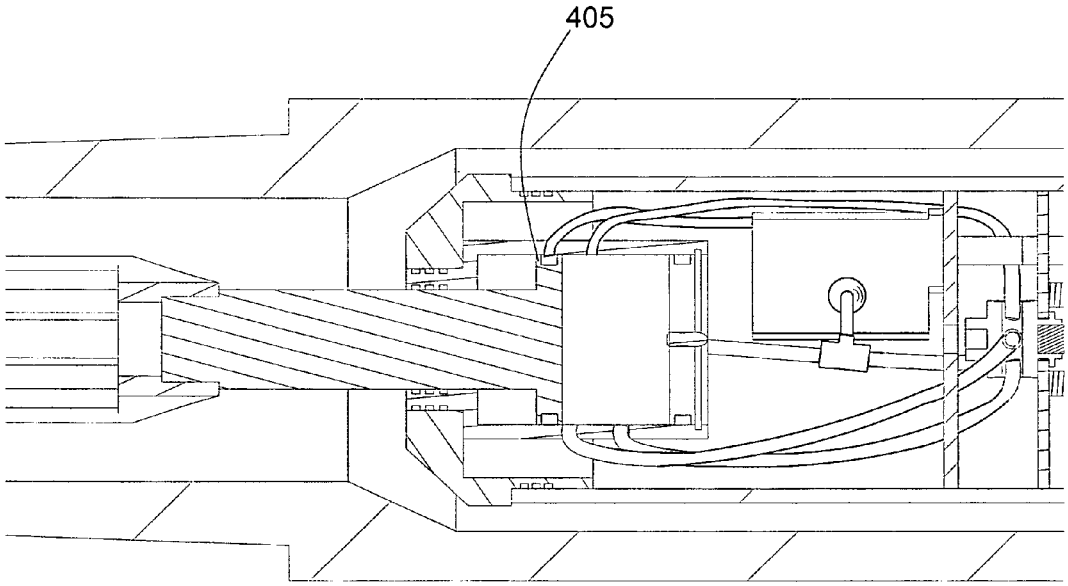

FIG. 9 also displays an alternative embodiment of guide channel 367 and receptacle 383. In this embodiment, the receptacle 383 comprises a cylindrical bin 388. The cylindrical bin 388 may comprise an opening 385 at a first end 386 comprising a geometry shaped to accept the mechanical actuation device 366 and accompanying drilling fluid. The cylindrical bin 388 may also comprise a second end 387 comprising a geometry shaped to restrict the mechanical actuation device 366 while allowing drilling fluid to pass. After a mechanical actuation device 366 has traveled through the guide channel 367 it may flow into the opening 385 and rest against the second end 387 or stack upon layers of other mechanical actuation devices 366.

Figure 14:
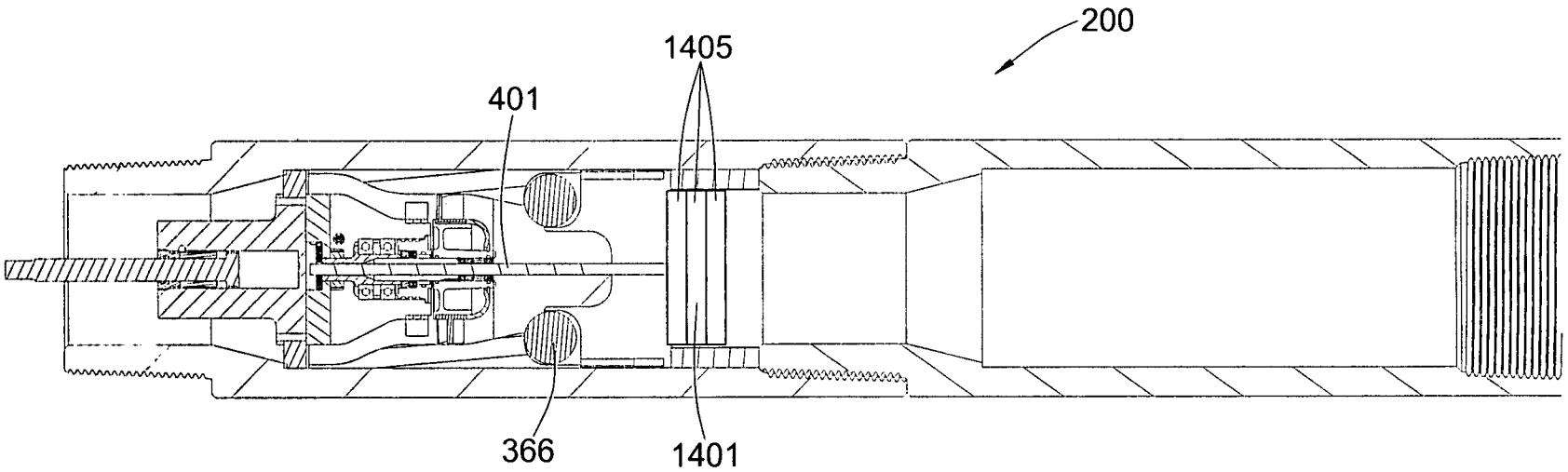
FIG. 14 is a cross-sectional diagram of an embodiment of a downhole tool string component comprising an incrementing paddlewheel.

FIG. 14 is a cross-sectional diagram of an embodiment of a downhole drill string component 200 comprising an incremental paddlewheel 1401. The paddlewheel 1401 may comprise a plurality of arms 1405 attached to a wheel such that as a mechanical actuation device 366 is pushed passed the paddlewheel 1401, the paddlewheel 1401 is rotated by the mechanical actuation device 366 contacting at least one of the plurality of arms 1405. The rotation of the paddlewheel 1401 may then cause the shaft 401 to rotate in a similar fashion to previous embodiments.

Figure 15:
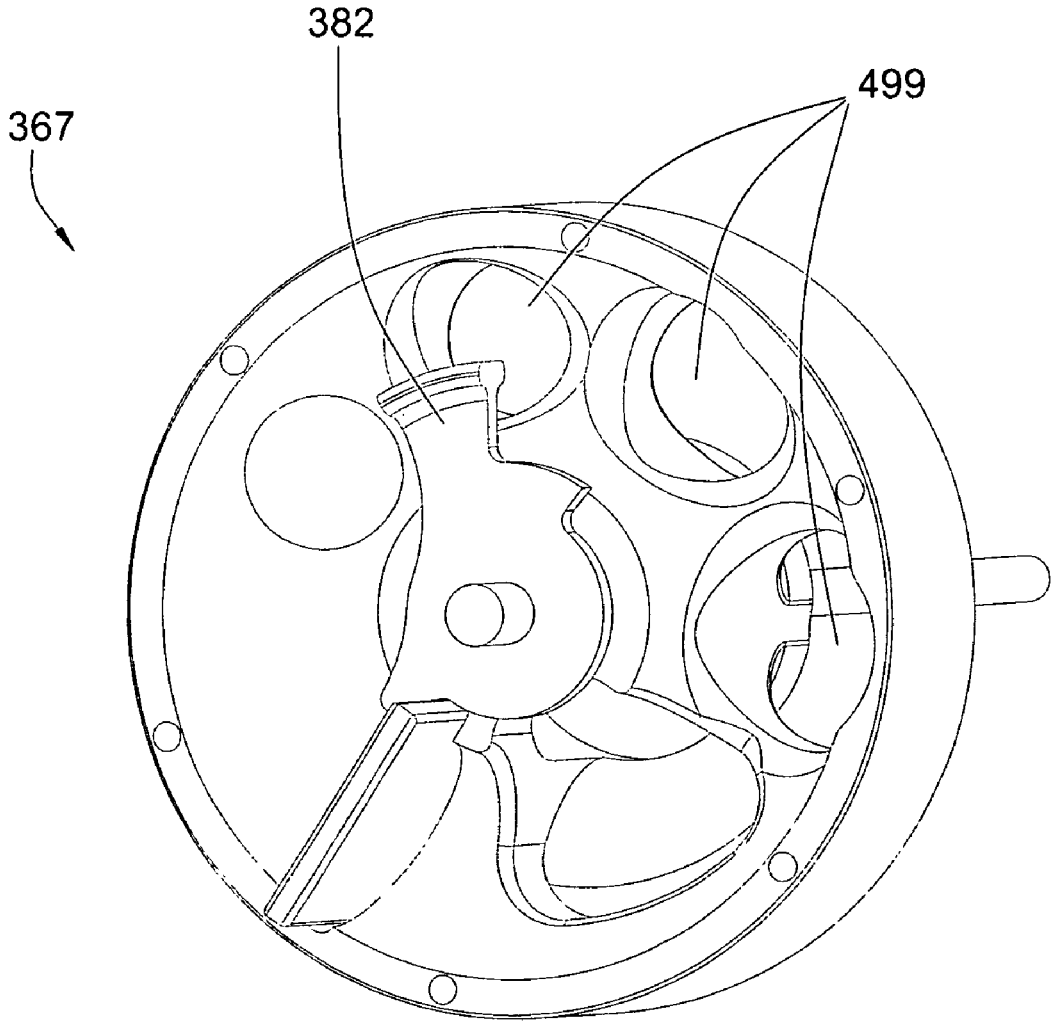
FIG. 15 is a perspective diagram of an embodiment of a guide channel.

FIG. 15 displays a perspective diagram of an alternate embodiment of the guide channel 367. In this embodiment, the guide channel 367 comprises a plurality of exits 499 of varying diameter. The plurality of exits 499 may be sized to accept a plurality of mechanical actuation devices (not shown) of varying diameter. As a mechanical actuation device is forced into the guide channel 367 by drilling fluid, the device may rotate a switch 382. The device may pass over each of the exits 499 until the device reaches an exit in the plurality of exits 499 comprising a diameter larger than the diameter of the device. The diameter of each of the exits 499 may increase starting with the exit 499 disposed closest to a starting position of the switch 382. The switch 382, in effect, may be rotated any number of degrees, depending on which exit 499 the device is passed through. A device comprising a diameter too large to pass through all exits 499 except the largest diameter exit 499 may rotate the switch 382 through a maximum rotation range. A device comprising a diameter small enough to pass through the exit 499 comprising the smallest diameter may rotate the switch 382 through the smallest rotation range.

Figure 16:
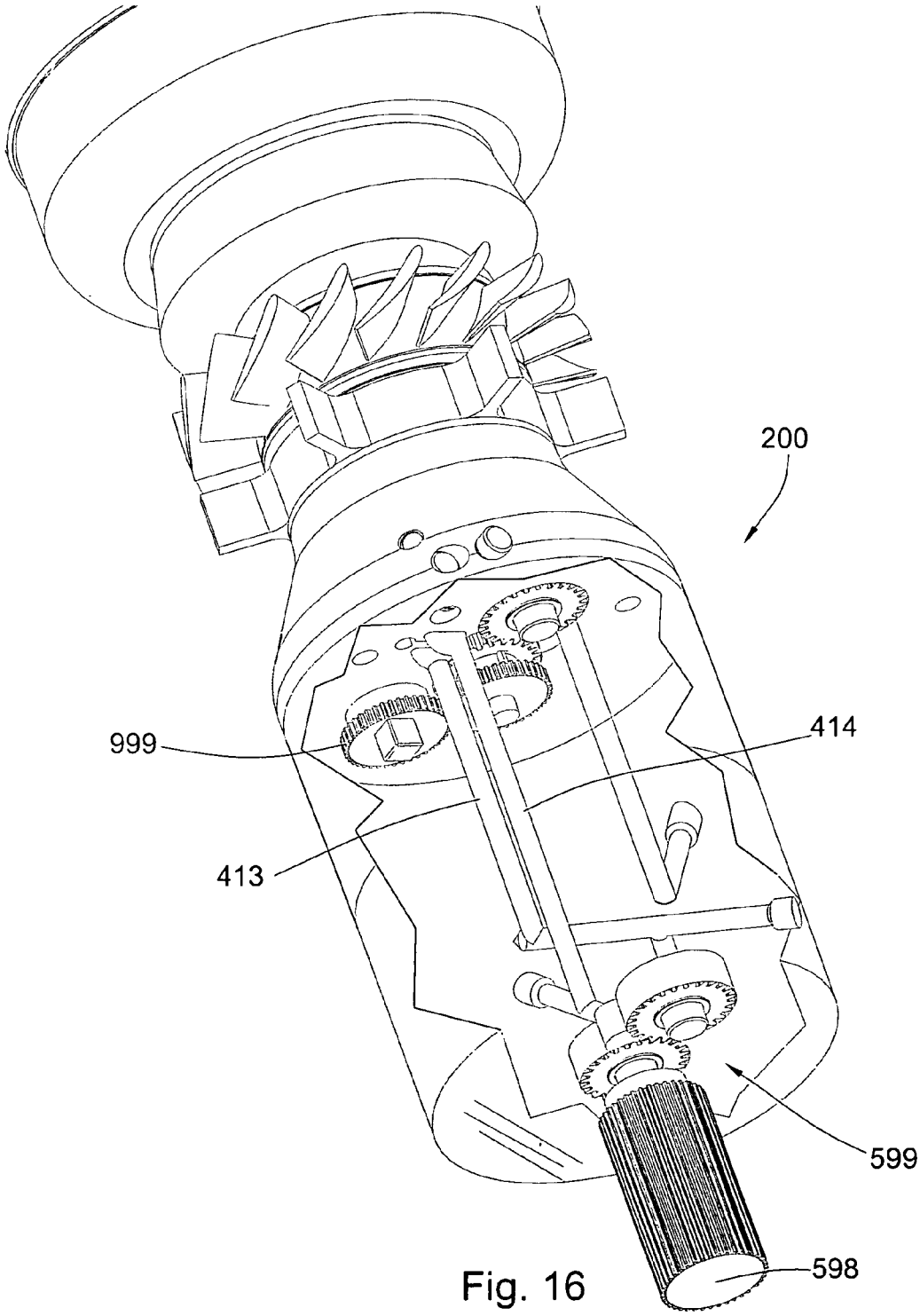
FIG. 16 is a perspective cut-away diagram of an embodiment of a downhole tool string component comprising a gear motor.

FIG. 16 is a perspective cut-away diagram of an embodiment of a downhole tool string component 200 comprising a gear motor 599. In this embodiment, the hydraulic lines 413 and 414 may be routed to channel hydraulic fluid from the gear pump 999 to a gear motor 599. As the gear pump 999 forces hydraulic fluid through the hydraulic lines 413 and 414, the exiting hydraulic fluid may cause the gear motor 599 to rotate. The first hydraulic line 413 may cause the gear motor 599 to rotate one direction and the second hydraulic line 414 may cause the gear motor 599 to rotate in an opposite direction. One of the gears comprised within the gear motor 599 may comprise a driving gear 598 adapted to provide rotational motion to a downhole tool (not shown).

Figure 17:
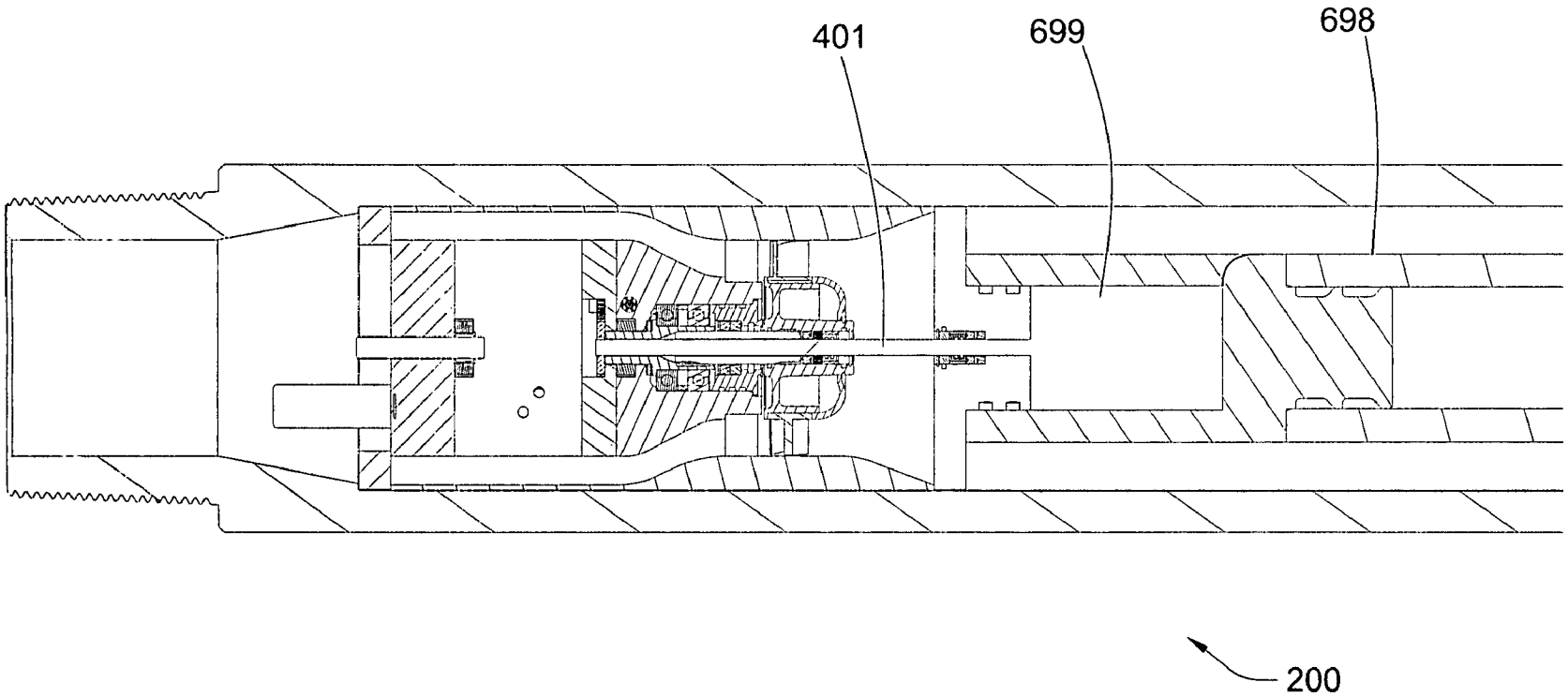
FIG. 17 is a cross-sectional diagram of an embodiment of a downhole tool string component comprising a motor.

FIG. 17 displays a cross-sectional diagram of an embodiment of a downhole tool string component 200 comprising a motor 699. The motor 699 may be in mechanical communication with the shaft 401 and in electrical communication with a telemetry network 698. U.S. Pat. No. 6,670,880 to Hall et al. which is herein incorporated by reference for all that it contains, discloses a telemetry system that may be compatible with the present invention; however, other forms of telemetry may also be compatible such as systems that include mud pulse systems, electromagnetic waves, radio waves, wired pipe, and/or short hop. The motor 699 may rotate the shaft 401 in a similar fashion to previous embodiments or it may index the shaft 401 forwards and reverse to specified positions.

Figure 18:
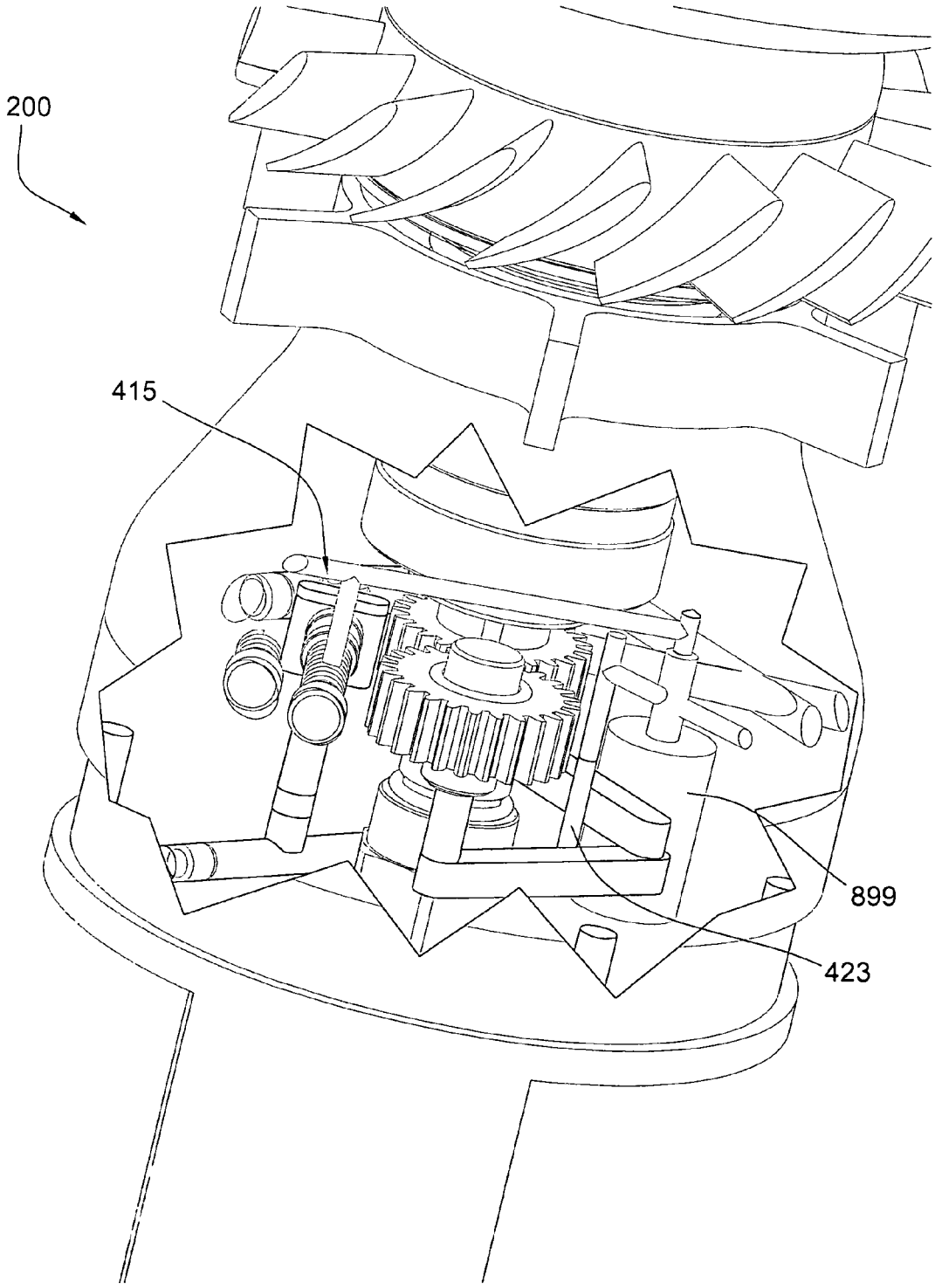
FIGS. 18 and 19 are perspective cut-away diagrams of an embodiment of a downhole tool string component comprising a solenoid valve.
Figure 19:
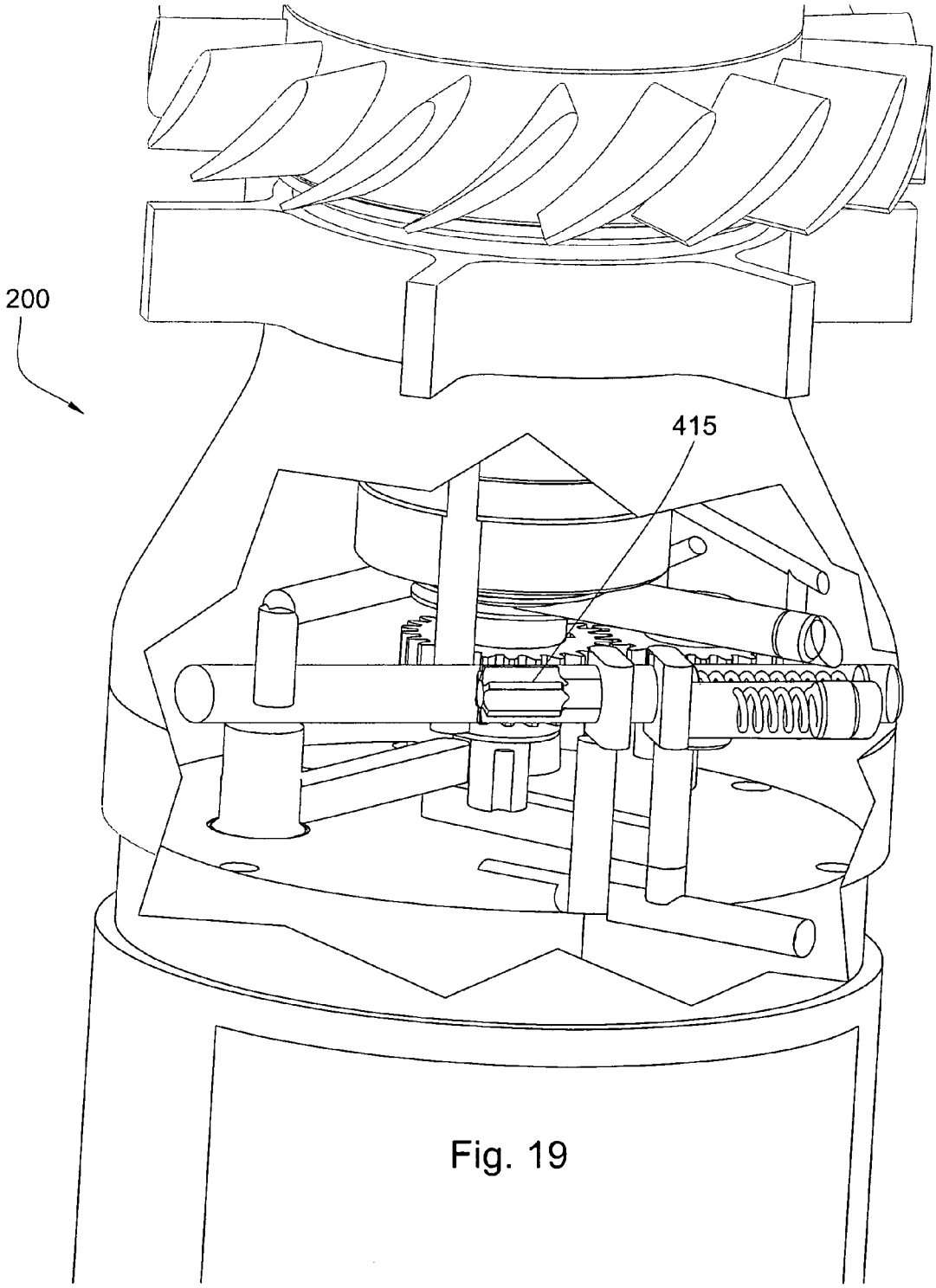

FIGS. 18 and 19 display perspective cut-away diagrams of an embodiment of a downhole tool string component 200 comprising a solenoid 899. The solenoid 899 may be in communication with and actuatable through a telemetry network 698. (See FIG. 17) Hydraulic fluid may be forced through a hydraulic line 423 from an exhaust reservoir 418. (See FIG. 7) The solenoid 899 may restrict the flow from the exhaust reservoir 418 from reaching a valve mechanism 415 or may allow the flow to advance through the hydraulic line 423 to the valve mechanism 415. By regulating the operation of the solenoid 899 by means of the telemetry network, the movement of the valve mechanism 415 may be controlled.

Figure 20:
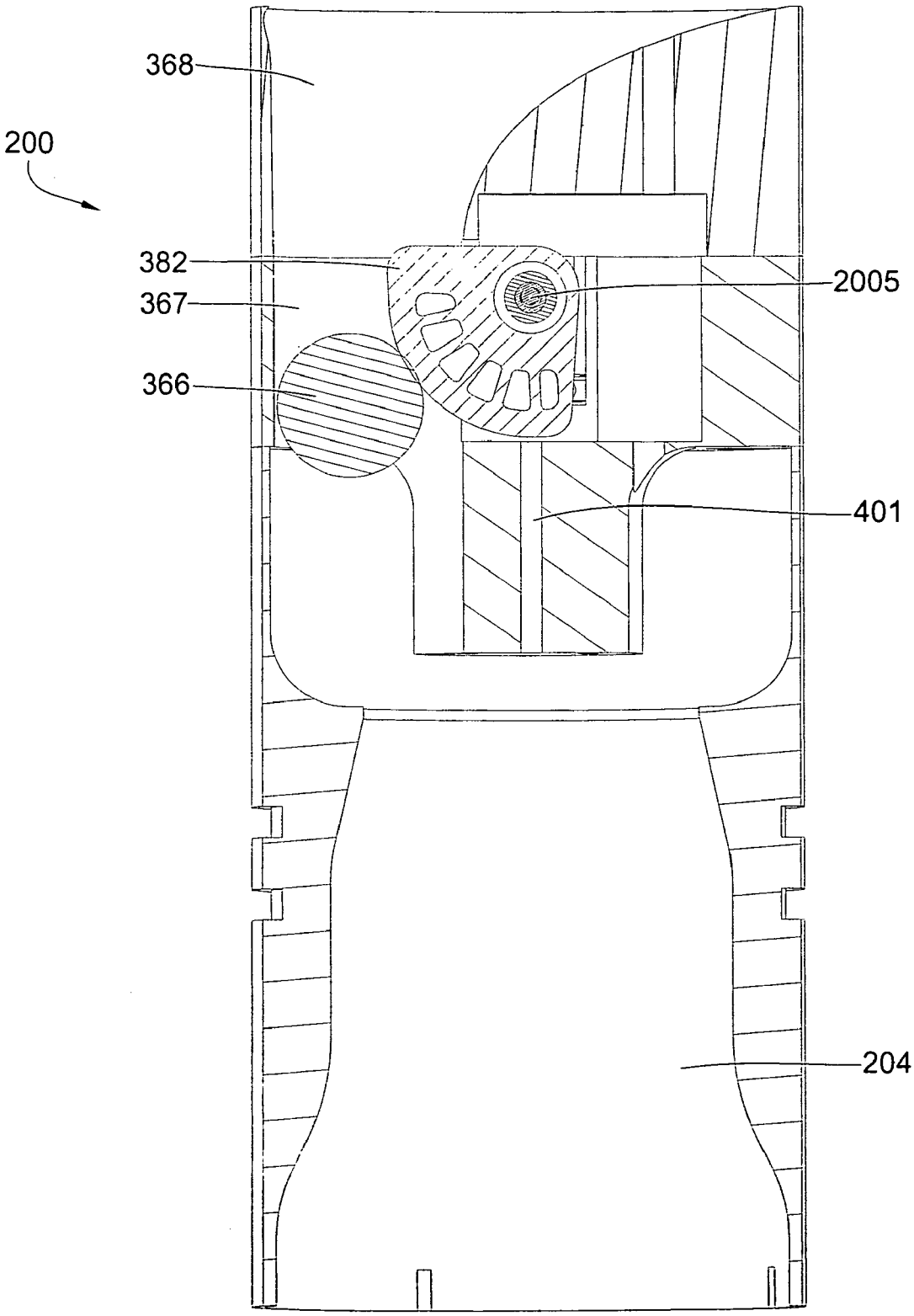
FIG. 20 is a cross-sectional side view diagram of an embodiment of a downhole tool string component comprising a guide channel in a substantially axial orientation.
Figure 21:
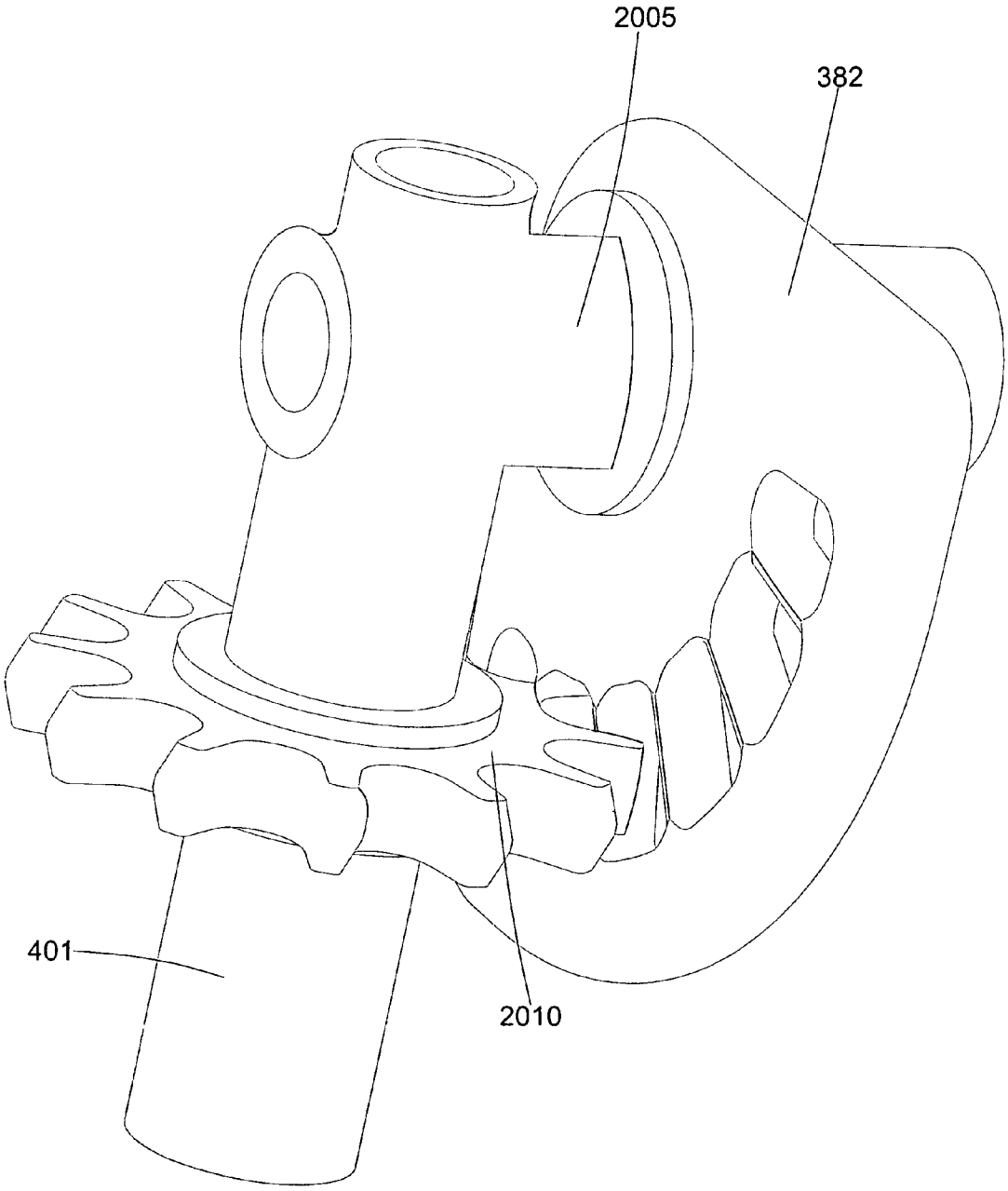
FIG. 21 is a perspective view diagram of an embodiment of a switch, a gear system, and a shaft.

FIGS. 20 and 21 display another embodiment of a downhole tool string component 200 comprising a through bore 204 formed to accept drilling fluid. A mechanical actuation device 366 may be disposed within the through bore 204. Also disposed within the through bore 204 may be a funnel 368 leading into a guide channel 367. In this embodiment, the guide channel 367 sits in a substantially axial orientation. A switch 382 may be disposed within the guide channel 367. As the mechanical actuation device 366 passes through the guide channel 367 it may actuate the switch 382. In this embodiment the switch 382 may be actuated by rotating around a radial fulcrum 2005. A gear system 2010 may transfer the rotational motion around the radial fulcrum 2005 to a substantially axial shaft 401.

Figure 22:
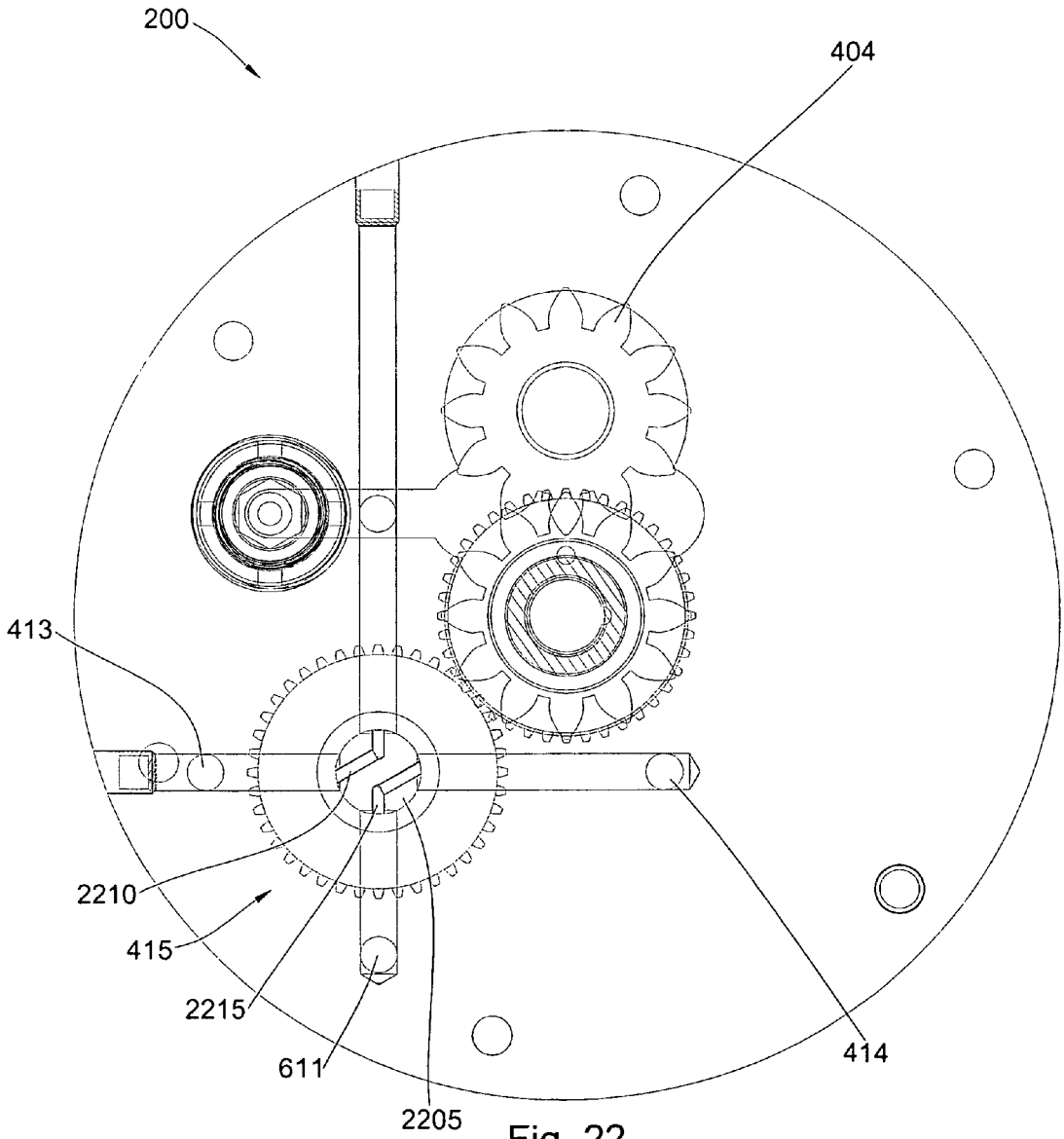
FIG. 22 is an axial cross-sectional diagram of an embodiment of a downhole tool string component comprising a ball valve.

FIG. 22 shows an axial cross section view of another embodiment of a downhole tool string component 200 comprising a valve mechanism 415. In this embodiment, the valve mechanism 415 comprises a ball valve 2205. The ball valve 2205 may comprise two internal ports 2210 and 2215 and may be free to rotate. A pump 404 may thrust hydraulic fluid through the first internal port 2210 and into a first hydraulic line 413. A second hydraulic line 414 may then be fluidly connected through the second internal port 2215 with an exhaust port 611. As the ball valve 2205 rotates, the pump 404 may thrust hydraulic fluid through the second internal port 2215 and into the second hydraulic line 414. The first hydraulic line 413 may then be fluidly connected through the first internal port 2210 with the exhaust port 611.

Whereas the present invention has been described in particular relation to the drawings attached hereto, it should be understood that other and further modifications apart from those shown or suggested herein, may be made within the scope and spirit of the present invention.

What is claimed is:

1. A downhole tool string component, comprising:

a through bore formed to accept drilling fluid;

a sealed chamber within the through bore;

a pump disposed within the sealed chamber;

a piston assembly comprising a piston with a head within a cylinder within the sealed chamber and an end extending beyond the sealed chamber;

the cylinder comprising at least one entry port fluidly connected to the pump and a plurality of exhaust ports; and a valve mechanism that selectively opens at least one of the exhaust ports.

2. The component of claim 1, wherein the valve mechanism is actuated by a solenoid that is in electrical communication with a downhole network.

3. The component of claim 1, wherein the valve mechanism is actuated by a cam that is in mechanical communication with a ratcheting device.

4. The component of claim 1, wherein the valve mechanism is actuated by a motor in electrical communication with a telemetry network.

5. The component of claim 1, wherein the piston end is attached to an axially translatable sleeve within the through bore.

6. The component of claim 5, wherein the axially translatable sleeve comprises at least one port, wherein the at least one port is spaced on the sleeve to align with a channel formed within a wall of the through bore.

7. The component of claim 6, comprising a translatable plunger fluidly connected to the through bore when the at least one port is aligned with the channel.

8. The component of claim 7, wherein the translatable plunger is in mechanical communication with a reamer on an exterior of the component.

9. The component of claim 7, wherein the translatable plunger is in mechanical communication with a stabilizer on an exterior of the component.

10. The component of claim 1, wherein the valve mechanism is a spool valve or a ball valve.

11. The component of claim 1, wherein the plurality of exhaust ports are fluidly connected to the pump.

12. The component of claim 11, wherein the valve mechanism is a multi-way valve that selectively opens the plurality of exhaust ports.

13. The component of claim 11, wherein the plurality of exhaust ports are spaced along the length of the cylinder.

14. The component of claim 1, wherein the pump is powered by a turbine disposed within the through bore and in mechanical communication with the pump.

15. The component of claim 1, wherein the pump is powered by a battery.

16. The component of claim 1, further comprising an exhaust reservoir fluidly connected to the cylinder.

17. The component of claim 16, wherein the exhaust reservoir comprises a spring loaded piston slidably disposed within the exhaust reservoir.

18. A method for incrementally moving a piston in a downhole tool string component, comprising the steps of:

providing a through bore formed in the downhole tool string component to accept drilling fluid, a sealed chamber disposed within the through bore, a pump disposed within the sealed chamber, and a piston assembly within the sealed chamber;

the piston assembly comprising a piston element disposed within a cylinder and forming a head and a piston element with an end extending beyond the sealed chamber;

pumping hydraulic fluid to a first end of the cylinder from the pump;

displacing the head a first distance from the first end of the cylinder toward a second end of the cylinder;

displacing the head a second distance from the first end of the cylinder toward the second end of the cylinder; and exhausting hydraulic fluid from the second end of the cylinder.

19. The method of claim 18, further comprising the step of moving a reamer or stabilizer blade from the exterior of a downhole tool string component by moving the piston assembly.

20. A downhole tool string component, comprising:

a through bore formed to accept drilling fluid;

a pump disposed within the through bore;

a valve mechanism that selectively opens a hydraulic line in fluid communication with the pump; and a gear motor in fluid communication with the hydraulic line wherein the pressure in the hydraulic line actuates the gear motor.

* * * * *